US005331110A

United States Patent [19]

Chen

[11] Patent Number: 5,331,110

[45] Date of Patent: Jul. 19, 1994

[54] MUSICAL BOX

[76] Inventor: Joseph Chen, P.O. Box 82-144, Taipei, Taiwan

[21] Appl. No.: 136,321

[22] Filed: Oct. 13, 1993

[51] Int. Cl.[5] ..... G10F 1/12

[52] U.S. Cl. ..... 84/95.2; 446/298; D17/24

[58] Field of Search ..... 84/94.1, 94.2, 95.1, 84/95.2; 40/411, 415; 446/280, 281, 282, 298, 303, 236, 297; D17/24

[56] References Cited

U.S. PATENT DOCUMENTS

| | | | |
|---|---|---|---|
| 233,377 | 10/1880 | Schwartz . | |
| 1,777,712 | 10/1930 | Barnum | 446/297 |
| 4,197,778 | 4/1980 | Komatsu et al. | 84/95.2 |
| 5,088,218 | 2/1992 | Liu | 84/95.2 |
| 5,088,373 | 2/1992 | Hou | 84/95.2 |

*Primary Examiner*—Michael L. Gellner
*Assistant Examiner*—Cassandra C. Spyrou
*Attorney, Agent, or Firm*—Alfred Lei

[57] ABSTRACT

This invention relates to a musical box and in particular to one including a base; a seat fixedly mounted on said base and provided with a casing in which is fitted a spiral spring, said spiral spring being connected with a control lever and a gear train, said gear train being engaged with a gear fixedly mounted on one end of a drum provided with a plurality of protuberances thereon; a hitting member fixedly mounted on said seat and having a plurality of tines in contact with said drum; a disc connected with the other end of said drum; a frame having a first leg fixedly mounted on said hitting member and a second leg fixedly mounted on said seat; an axle extending downwardly and vertically through said frame to gear with a second gear meshed with said gear fixedly mounted on one end of said drum; an arm sleeved over said axle and a hole of said disc; a connector put on to said axle; and a sleeve fitted on said axle.

1 Claim, 4 Drawing Sheets

MUSICAL BOX

BACKGROUND OF THE INVENTION

It is found that the conventional musical box is simply a box with a mechanical device that produces a tune when the box is opened. However, such a musical box is monotonous and too complicated in structure thereby increasing the cost thereof.

Therefore, it is an object of the present invention to provide a musical box which may obviate and mitigate the above-mentioned drawbacks.

SUMMARY OF THE INVENTION

This invention relates to a musical box.

It is the primary object of the present invention to provide a musical box which will cause a doll to go up and down when producing music.

It is another object of the present invention to provide a musical box which is simple in construction.

It is still another object of the present invention to provide a musical box which is compact in size.

It is still another object of the present invention to provide a musical box which is economic to manufacture.

It is a further object of the present invention to provide a musical box which is amusing and interesting.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description.

Figure 1:
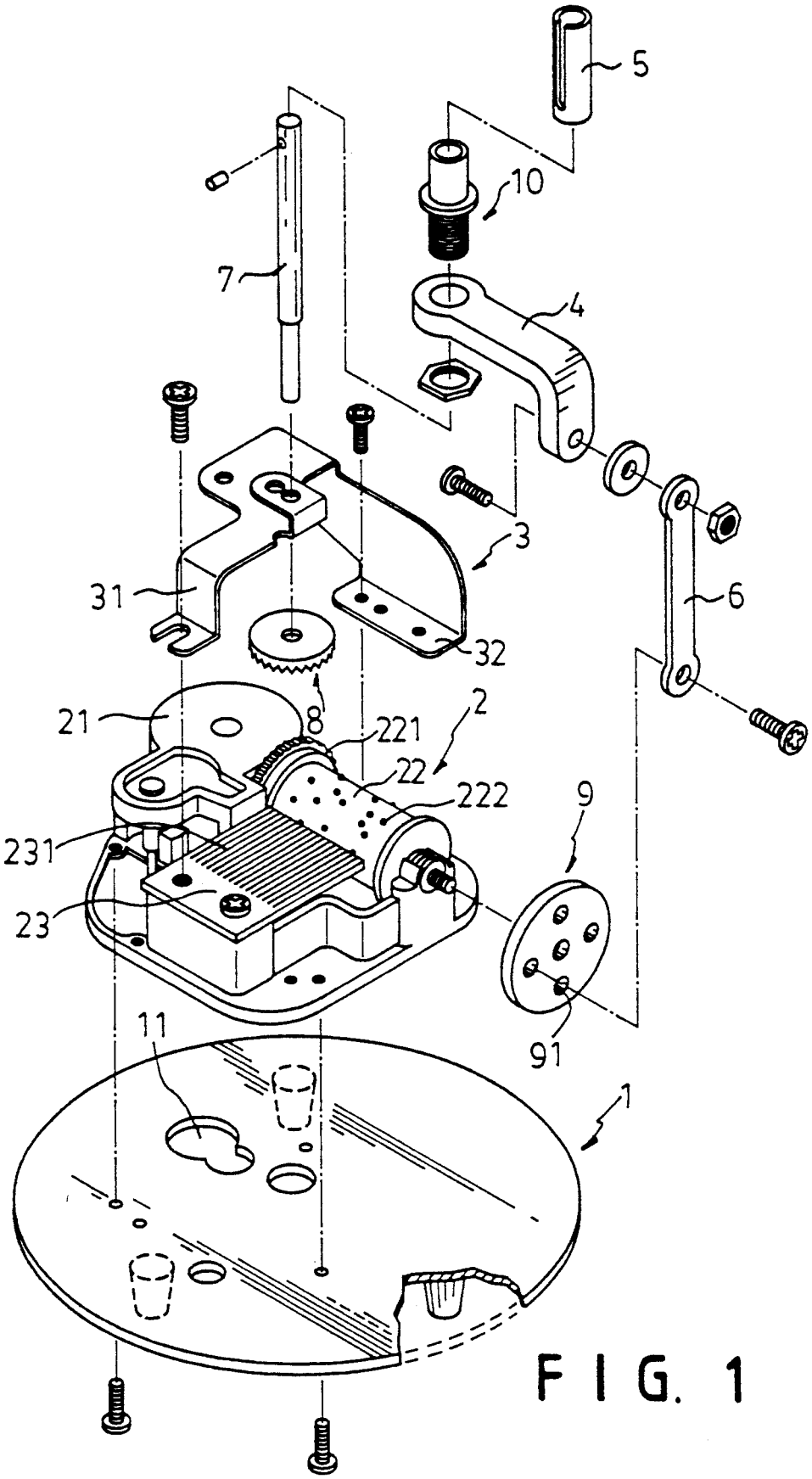
FIG. 1 is an exploded view of the present invention.
Figure 2:
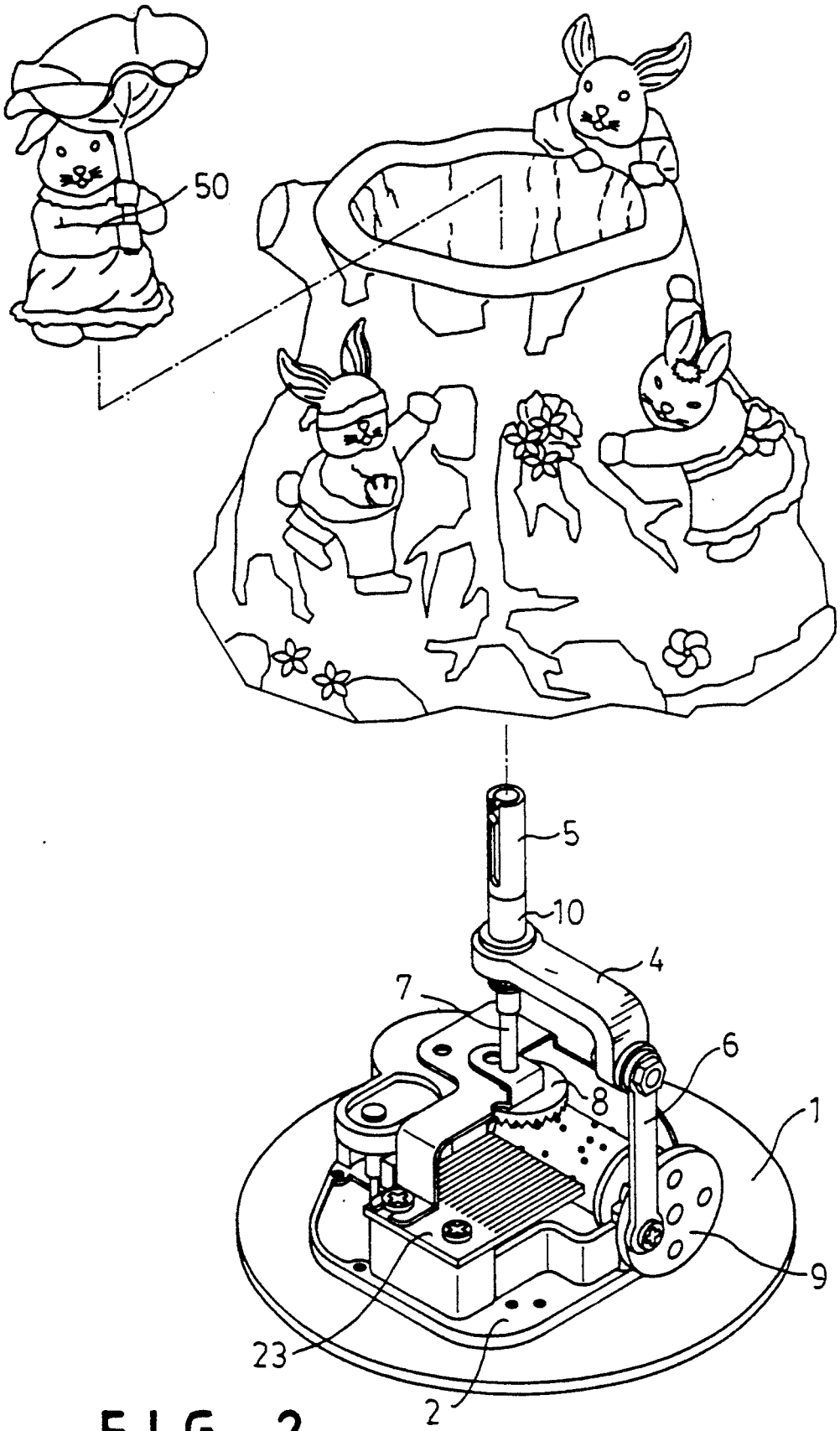
FIG. 2 is a perspective view of the present invention.
Figure 4:
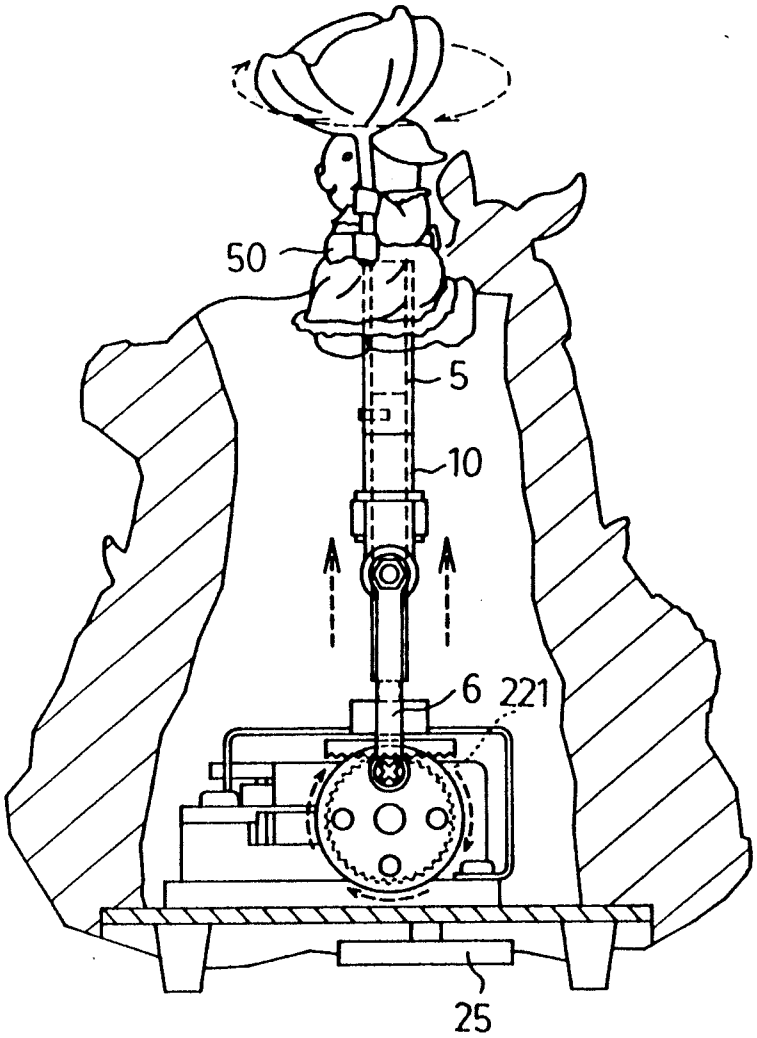
FIGS. 3, 4, 5 and 6 show the working principle of the present invention.
Figure 3:
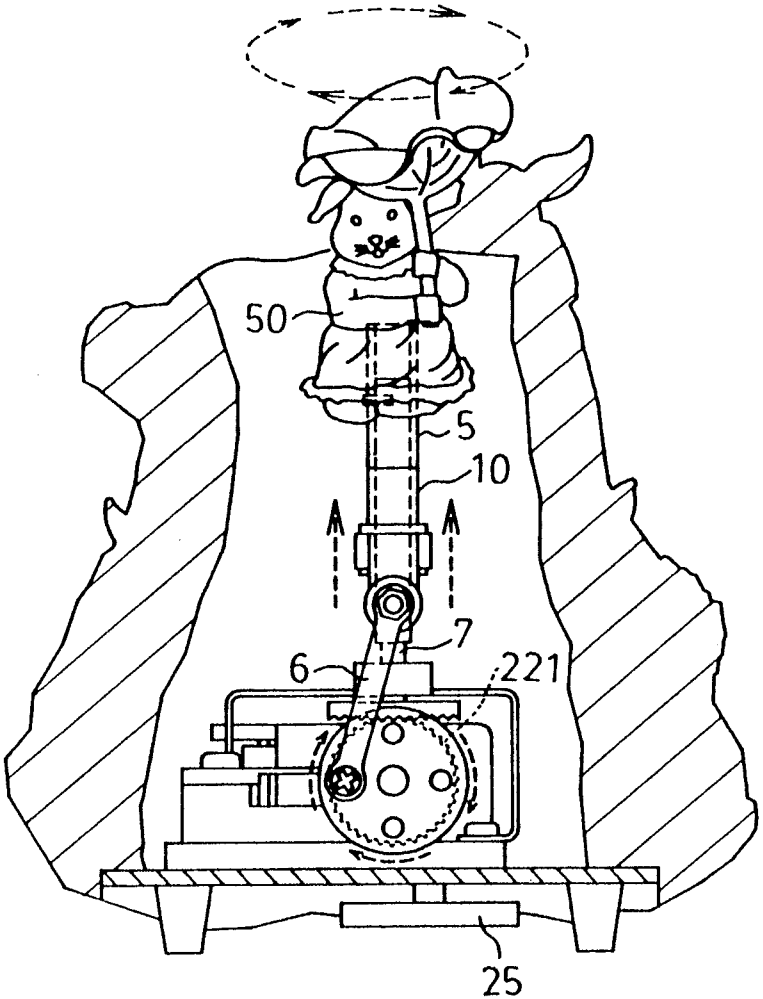
Figure 6:
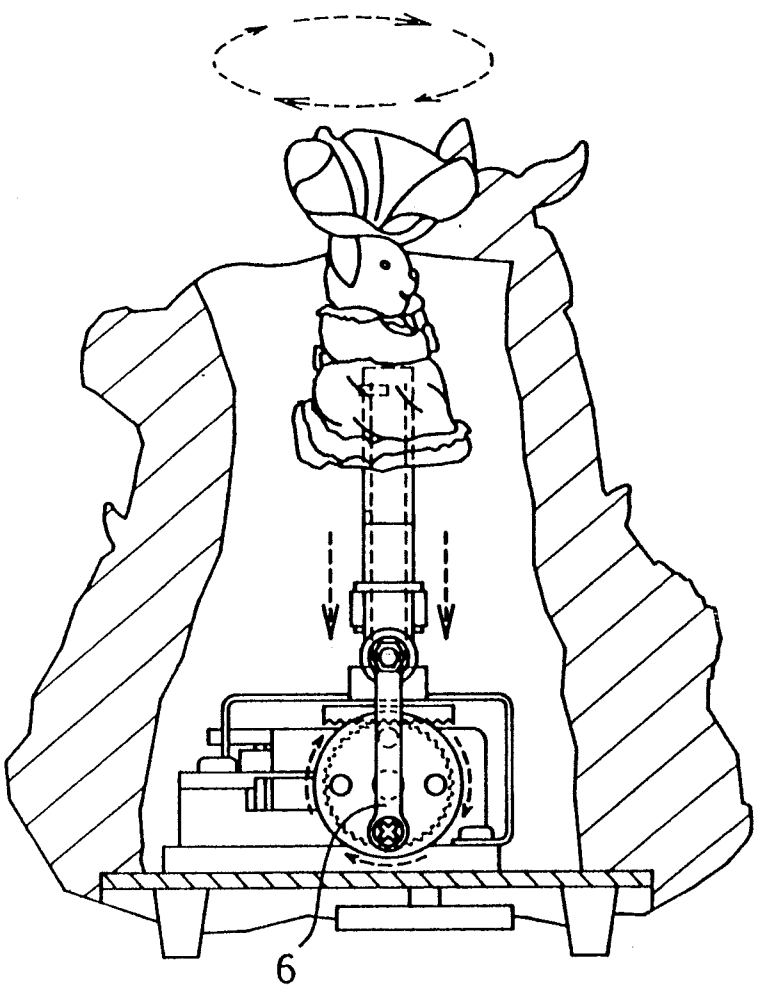
Figure 5:
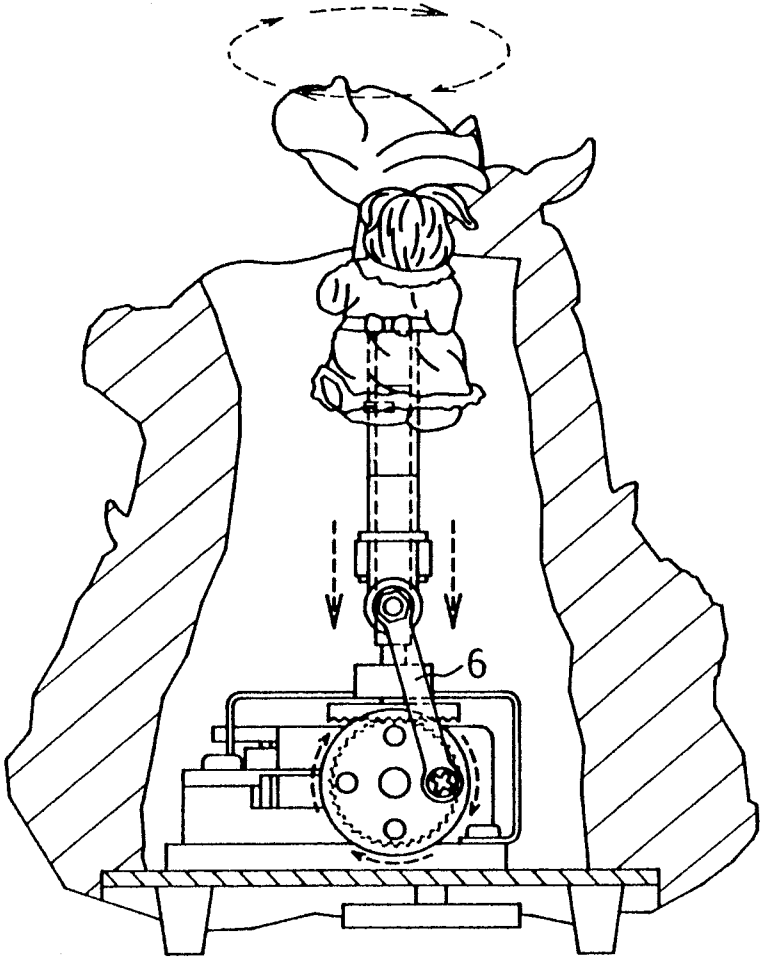

With reference to the drawings and in particular to FIGS. 1 and 2 thereof, the musical box according to the present invention mainly comprises a base 1, a seat 2, a frame 3, an arm 4, a sleeve 5, a crank 6, an axle 7, a gear 8, a disc 9, and a connector 10.

As illustrated, the seat 2 is fixedly mounted on the base 1 by screws (not shown). On the seat 2 are mounted a casing 21 in which is fitted a spiral spring (not shown). The spiral spring is connected with a control lever 25 by means of which the spiral spring can be turned tight. The spiral spring is connected with a gear train (not shown) so that the spiral spring will drive the gear train to rotate. The gear train is in turn engaged with a gear 221 which is fixedly mounted on one end of a drum 22 formed with a plurality of protuberances 222 thereon. A hitting member 23 having a plurality of tines 231 is fixedly mounted on the seat, with its tines 231 contacting the surface of the drum 22. A disc 9 is connected with the other end of the drum 22 and is formed with a plurality of holes 91.

The frame 3 is provided with a first leg 31 fixedly mounted on the hitting member 23 and a second leg 32 fixedly mounted on the seat 2. The axle 7 extends downwardly and vertically through the frame 3 to engage with a gear 8 which is meshed with the gear 221 fixedly mounted on one end of the drum 22. The arm 4 is sleeved over the axle 7 and connected with a hole 91 of the disc 9 via a crank 6. The connector 10 is put on to the axle 7 and supported by the arm 4. The sleeve 5 is put on to the axle 7 and disposed on the connector 10. A doll 50 is fixedly mounted on the upper end of the axle 7 and disposed above the sleeve 5.

Referring to FIGS. 3, 4, 5 and 6, there are shown the working principle of the present invention. When desired to produce music, simply turn the control lever 25 to turn the spiral spring tight and release the control lever 25. Then, the spiral spring will drive the gear train which will in turn drive the gear 221 thereby rotating the drum 22 and the disc 9. As the drum 22 is rotated, the tines 231 of the hitting member 23 will hit the protuberances 222 of the drum 22 hence producing music. Meanwhile, the gear 221 will rotate the gear 8 thus rotating the axle 7. When the disc 9 is rotated, the arm 4 together with the connector 10 and the sleeve 5 will be moved upward and downward alternately by the crank 6. Hence, the doll 50 will be moved upward and downward alternately by the crank and rotated by the axle 7.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A musical box comprising:

a base;

a seat having a casing; said seat fixedly mounted on said base;

a spiral spring fitted within said casing;

a control lever connected to said spring;

a drum having a first end and a second end; said drum including a plurality of protuberances thereon;

a gear fixedly mounted on said first end of said drum;

a gear train connected to said spring and engaging said gear;

a hitting member fixedly mounted on said seat and having a plurality of tines in contact with said drum;

a disc having a hole; said disc connected to said second end of said drum;

a frame having a first leg and a second leg; said first leg connected to said hitting member and said second leg connected to said seat;

a second gear meshed with said gear;

an axle extending downward and vertically through said frame and engaging said second gear;

an arm sleeved over said axle and connected to said hole of said disc;

a connector attached to said axle; and a sleeve fitted over said axle.

* * * * *